US007392001B2

(12) United States Patent
Okazaki

(10) Patent No.: US 7,392,001 B2
(45) Date of Patent: Jun. 24, 2008

(54) TRANSFER BELT DEVICE AND IMAGE FORMING APPARATUS

(75) Inventor: Noritaka Okazaki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 302 days.

(21) Appl. No.: 11/238,457

(22) Filed: Sep. 28, 2005

(65) Prior Publication Data

US 2006/0067746 A1 Mar. 30, 2006

(30) Foreign Application Priority Data

Sep. 28, 2004 (JP) ..... 2004-282452

(51) Int. Cl.
*G03G 15/01* (2006.01)

(52) U.S. Cl. ..... 399/299; 399/302

(58) Field of Classification Search ..... 399/299, 399/298, 302

See application file for complete search history.

(56) References Cited

U.S. PATENT DOCUMENTS 6,173,141 B1 * 1/2001 Sakagami et al.
2006/0067745 A1 * 3/2006 Yamada et al. ..... 399/302
2007/0071486 A1 * 3/2007 Chiba et al. ..... 399/299
2007/0116496 A1 * 5/2007 Morimoto et al. ..... 399/299
2007/0166080 A1 * 7/2007 Kwak ..... 399/299

FOREIGN PATENT DOCUMENTS

| | | | |
|---|---|---|---|
| JP | 08-069238 | | 3/1996 |
| JP | 2000-242057 | | 9/2000 |
| JP | 2002-139887 | | 5/2002 |
| JP | 2002139887 A | * | 5/2002 |
| JP | 2004-109267 | | 4/2004 |

* cited by examiner

*Primary Examiner*—Susan S Lee
(74) *Attorney, Agent, or Firm*—George W. Neuner; David G. Conlin; Edwards Angell Palmer & Dodge LLP

(57) ABSTRACT

A first transfer unit having a monochrome image frame in which a monochrome image primary transfer roller is supported, and a second transfer unit having a color image frame in which a plurality of color image primary transfer rollers are supported, are linked such that they can swing at a rotating shaft of a first rotating cam and a second rotating cam.

18 Claims, 12 Drawing Sheets

TRANSFER BELT DEVICE AND IMAGE FORMING APPARATUS

This Nonprovisional application claims priority under 35 U.S.C. § 119(a) on Patent Application No. 2004-282452 filed in Japan on Sep. 28, 2004, the entire contents of which are hereby incorporated by reference.

BACKGROUND OF THE INVENTION

The present invention relates to a transfer belt device that transfers a developer image formed on an image bearing member to a recording medium or a transfer belt, and an image forming apparatus provided with this transfer belt device.

In recent years, there has been active development of image forming apparatuses from the two aspects of converting to color and increasing speed. In the colorization of image forming apparatuses, instead of quad-rotational process systems using one image forming station, tandem systems using multiple image forming stations that are able to increase speed have become mainstream.

Tandem image forming apparatuses are provided with a transfer belt device having an endless transfer belt that forms a transport path that transports a recording medium or a developer image, and multiple image forming stations corresponding to each hue arranged in parallel along the transport path, and can perform both color image formation and monochrome (black and white) image formation.

Also, in tandem image forming apparatuses it is possible to set different image forming performance for a color image forming mode that forms color images and for a monochrome image forming mode that forms monochrome images.

For example, there are tandem image forming apparatuses with a configuration wherein the image forming speed is made faster in the monochrome image forming mode, increasing the volume of image formation in monochrome image forming mode. Also, as disclosed in JP 2000-242057A, there are tandem image forming apparatuses with a configuration wherein the diameter of the image bearing member for monochrome images is made larger than the diameter of image bearing members for color images, making the usable time period of the image bearing member for monochrome images equal to that of the image bearing members for color images.

This is because ordinarily, in a single image forming apparatus the frequency of monochrome image formation is higher than that of color image formation. The image bearing member for monochrome images included in the image forming station for monochrome images is used for both color image formation and monochrome image formation, and so its frequency of use is higher than the image bearing members for color images included in the image forming station for color images. Thus, in comparison to the image bearing members for color images, the image bearing member for monochrome images will have a shorter usable time period even if the lifetime is the same.

Accordingly, it is possible to set the specifications for image forming performance, for example changing the speed of image formation in the monochrome image forming mode, for each model of tandem image forming apparatus. Also, in order to set the specifications for image forming performance that differs in each tandem image forming apparatus, specifications are ordinarily set for the color and monochrome image forming stations in each apparatus, and for the transfer belt device, according to the purpose of the image forming apparatus.

On the other hand, the transfer belt device provided in the tandem image forming apparatus is configured from a plurality of rollers that tightly stretch the transfer belt and a transfer unit that supports these multiple rollers. The transfer unit is configured from a plurality of transfer rollers arranged inside the transfer belt. The transfer roller is arranged such that it faces the image bearing member of each image forming station via the transfer belt, and transfers a developer image formed on the surface of the image bearing member of each image forming station onto the outer peripheral surface of the transfer belt or a recording medium transported on the outer peripheral surface of the transfer belt.

In recent years, there have been transfer belt device with a configuration wherein a monochrome image transfer roller and a plurality of color image transfer rollers are raised and lowered for each monochrome image forming mode and color image forming mode, changing the contact states between the transfer belt and the image bearing members in each mode. By doing so, in the monochrome image forming mode, the outer peripheral surface of the transfer belt only touches the monochrome image bearing member due to lowering the monochrome image transfer roller, and only the developer image formed on the surface of the monochrome image bearing member is transferred to the transfer belt.

On the other hand, in the color image forming mode, the outer peripheral surface of the transfer belt contacts the monochrome image bearing member and the color image bearing members due to lowering the monochrome image transfer roller and the plurality of color image transfer rollers, and the developer image formed on the surface of the monochrome image bearing member and the developer images formed on the surface of the plurality of color image bearing members are transferred to the transfer belt one on top of the other.

However, in the transport belt apparatus described above, because the transfer belt is tightly stretched by the plurality of rollers supported by the transfer unit, work to remove the transfer belt from the transfer unit and exchange it with a new one takes time. Accordingly, in the transfer belt device of recent years, as disclosed in JP H8-69238A and JP 2004-109267A, configurations have been adopted wherein a first transfer unit and a second transfer unit are linked together in the axial direction of the plurality of rollers by a parallel axle such that they can swing.

Thus, by swinging the first transfer unit or the second transfer unit into a V-shape, the tightly stretched transfer belt loosens and it becomes easy to exchange the transfer belt.

However, in a transfer belt device provided with a configuration wherein the transfer rollers are raised and lowered in each image forming mode, because the mechanism that raises and lowers the transfer rollers is disposed in a transfer unit, it is difficult to simply adopt the sort of configuration disclosed in JP H8-69238A and JP 2000-109267A. Even when such a configuration has been adopted, it is necessary to swing the transfer unit after first removing the configuration that raises and lowers the transfer rollers, and work to replace the transfer belt becomes troublesome.

It is an object of this invention to provide a transfer belt device wherein even if a configuration is provided that raises and lowers the transfer rollers in each image forming mode, a plurality of transfer units are linked with a simple configuration and can easily swing, making it possible to improve the workability of transfer belt replacement; and to provide an image forming apparatus provided with this transfer belt device.

SUMMARY OF THE INVENTION

The transfer belt device of the present invention is provided with an endless transfer belt that is tightly stretched by a plurality of rollers and forms a transport path in which a recording medium or developer image is transported facing a monochrome image bearing member and a plurality of color image bearing members arranged in parallel in one direction.

This transfer belt device is provided with a first transfer unit that includes at least one of the plurality of rollers, a monochrome image transfer roller that can be raised and lowered and that transfers a developer image formed on the monochrome image bearing member onto the recording medium or an outer peripheral surface of the transfer belt, a monochrome image transfer member movement mechanism provided with the monochrome image transfer roller, and a first linking member provided with the monochrome image transfer member movement mechanism; a second transfer unit that includes at least one of the plurality of rollers other than the roller included in the first transfer unit, a plurality of color image transfer rollers that can be raised and lowered and that transfer developer images formed on each of the plurality of color image bearing members onto the recording medium or the outer peripheral surface of the transfer belt, a color image transfer member movement mechanism provided with the plurality of color image transfer rollers, and a second linking member provided with the color image transfer member movement mechanism; and a driving mechanism that raises and lowers the transfer rollers via the monochrome image transfer member movement mechanism and the color image transfer member movement mechanism, and includes a single rotating shaft that receives a transmission of driving force and supplies the driving force to the monochrome image transfer member movement mechanism and the color image transfer member movement mechanism.

Further, in the transfer belt device, the first linking member and the second linking member are linked at the rotating shaft such that they can swing.

DESCRIPTION OF THE INVENTION

Following is a description of a transfer belt device and image forming apparatus according to a preferred embodiment of this invention with reference to the accompanying drawings.

Figure 1:
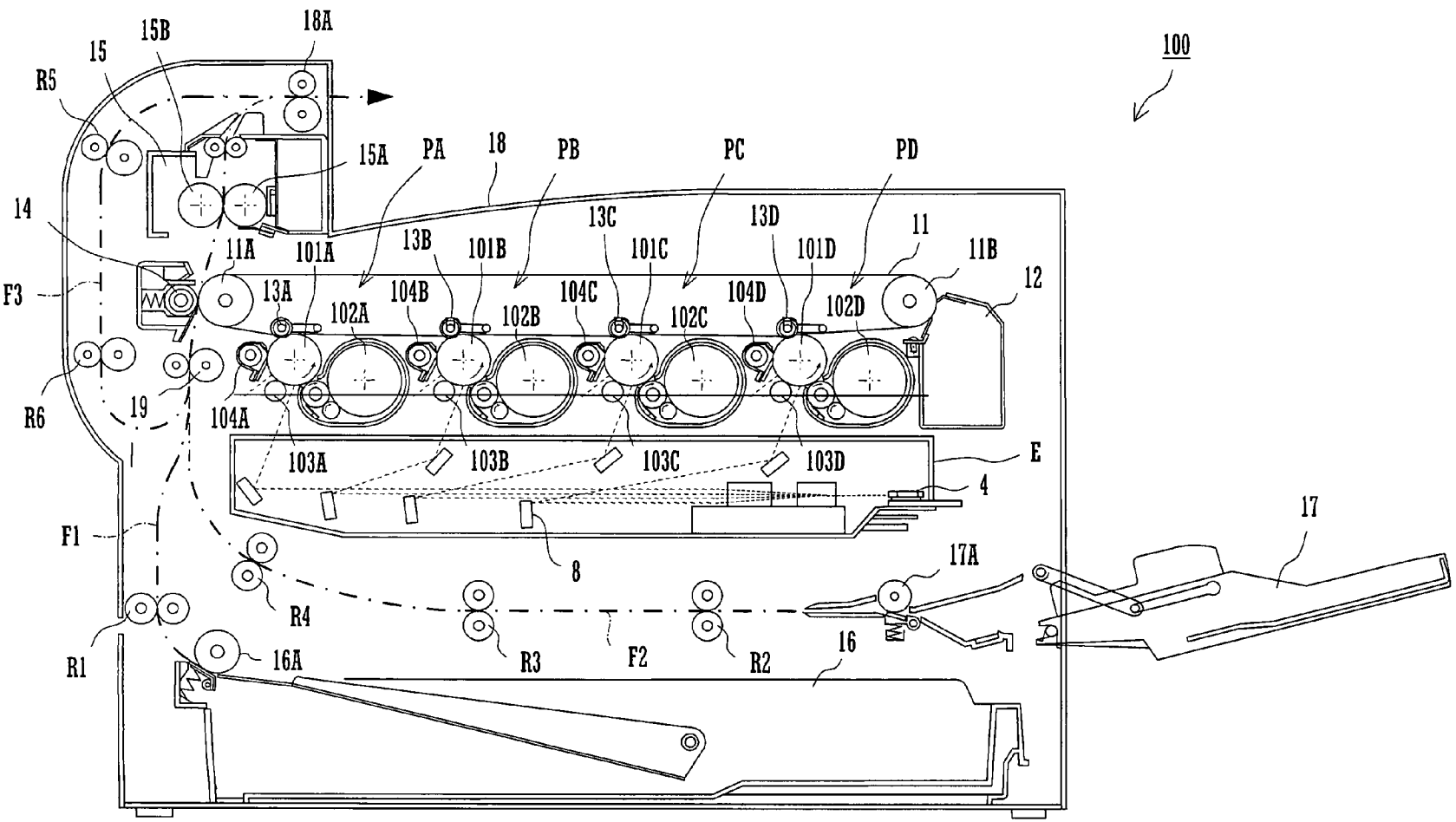
FIG. 1 is a diagram that shows the configuration of an image forming apparatus provided with a transfer belt device according to an embodiment of this invention.

FIG. 1 is a diagram that shows the configuration of an image forming apparatus provided with a transfer belt device according to an embodiment of this invention. An image forming apparatus 100 forms a multi-color and single-color image on a recording medium such as paper according to image data transmitted from outside. Thus, the image forming apparatus 100 includes an exposing unit E, photosensitive drums 101A through 101D (corresponding to the image bearing members of the present invention), developing units 102A through 102D, charging rollers 103A through 103D, cleaning units 104A through 104D, a transfer belt 11, primary transfer rollers 13A through 13D (corresponding to the transfer rollers of the present invention), a secondary transfer roller 14, a fixing apparatus 15, paper transport paths F1, F2, and F3, a paper supply cassette 16, a manual paper supply tray 17, and a discharge tray 18.

The image forming apparatus 100 performs image formation using image data corresponding to each hue of the four total colors black (K) and the three colors yellow (W), magenta (M), and cyan (Y), which are the three subtractive primary colors obtained by color separation of a color image. Four of the respective photosensitive drums 101A through 101D, the developing units 102A through 102D, the charging rollers 103A through 103D, the primary transfer rollers 13A through 13D, and the cleaning units 104A through 104D are provided corresponding to each hue, constituting four image forming stations PA through PD. The image forming stations PA through PD are arranged in parallel in the direction of movement of the transfer belt 11, which is a secondary scanning direction (corresponding to the fixed direction of the present invention).

The charging rollers 103A through 103D are contact charges that charge the surface of the photosensitive drums 101A through 101D to a uniform predetermined potential. A contact charger using a charging brush or a non-contact charger using a charging charge may be used in place of the charging rollers 103A through 103D. The exposing unit E includes a semiconductor laser (not shown), a polygon mirror 4 and a reflecting mirror 8, and irradiates laser beams modulated according to image data of each hue black, cyan, magenta, and yellow, respectively, to the respective photosensitive drums 101A through 101D. A latent electrostatic image is formed on the respective photosensitive drums 101A through 101D according to image data for the respective hues black, cyan, magenta, and yellow.

The developing units 102A through 102D supply developer (toner) to the surface of the photosensitive drums 101A through 101D, on which a latent electrostatic image has been formed, and make the latent electrostatic image manifest as a toner image. The respective developing units 102A through 102D contain the toner of the hues black, cyan, magenta, and yellow, and make the latent electrostatic images of the hues formed on the respective photosensitive drums 101A through 101D manifest as toner images of the hues black, cyan, magenta, and yellow. The cleaning units 104A through 104D remove/recover toner remaining on the surface of the photosensitive drums 101A though 101D after developing/image transfer.

The transfer belt 11 disposed above the photosensitive drums 101A through 101D is tightly stretched between a driving roller 11A and a driven roller 11B, and forms a transport path in which the toner image is transported. The outer peripheral surface of the transport belt 11 faces the photosensitive drum 101D, the photosensitive drum 101C, the photosensitive drum 101B, and the photosensitive drum 101A, in that order. The primary transfer rollers 13A through 13D are disposed in positions that sandwich this transfer belt 11 and face the photosensitive drums 101A through 101D. The positions where the transport belt 11 faces the photosensitive drums 101A through 101D are the primary transport positions.

The transfer belt 11 is provided with an endless shape using film with a thickness of about 100 μm to 150 μm, and volume resistance is a level of $10^{11}$ to $10^{12}$ Ω·cm. When the resistance value of the transfer belt 11 is lower than this level, leaks from the transfer belt 11 occur and it is not possible to maintain sufficient transfer power, and when the resistance value of the transfer belt 11 is higher than this level, a means to de-charge the transfer belt 11 after it has passed the transfer positions becomes separately necessary.

In order to transfer the toner image carried on the surface of the photosensitive drums 101A through 101D onto the transfer belt 11, a primary transfer bias with a polarity opposite to the toner charging polarity is applied to the primary transfer rollers 13A through 13D, which are the transfer members of the present invention, with a constant voltage control. Thus, the toner images of each hue formed on the photosensitive drums 101A through 101D are superimposed in order and transferred to the outer peripheral surface of the transfer belt 11, forming a color toner image on the outer peripheral surface of the transfer belt 11.

However, when image data for only some of the hues yellow, magenta, cyan, and black has been input, formation of a latent electrostatic image and toner image is performed on only some of the photosensitive drums among the four photosensitive drums 101A through 101D corresponding to the hues of the input image data. For example, when transferring a monochrome image, formation of a latent electrostatic image and toner image is performed only on the photosensitive drum 101A corresponding to the black hue, and only a black developer image is transferred to the outer peripheral surface of the transfer belt 11.

Also, in this embodiment of the invention, in order to make the amount of primary transfer bias conferred on the transfer belt 11 constant, whether performing color image transfer, wherein a toner image formed on the circumferential surface of the color image photosensitive drums 101B through 101D and a toner image formed on the circumferential surface of the monochrome image photosensitive drum 101A are transferred to the transfer belt 11, or monochrome image transfer, wherein a toner image formed on the circumferential surface of the monochrome image photosensitive drum 101A is transferred to the transfer belt 11, an equivalent primary transfer bias is always applied to all of the primary transfer rollers 13A through 13D. Accordingly, all of the primary transfer rollers 13A through 13D are always in contact with the transfer belt 11. If they are not always in contact, the amount of primary transfer bias conferred on the transfer belt 11 whenever image formation is performed will change, and variations will occur in the transfer accuracy of the toner images transferred to the transfer belt 11.

A primary transfer bias is applied to all of the primary transfer rollers 13A through 13D during the interval from the time that transfer of the original toner image to the transfer belt 11 has begun until transfer of toner images is complete. This is because when performing color image transfer or when performing monochrome image transfer, an equivalent primary transfer bias is always supplied to the transfer belt 11, which is in contact with the primary transfer rollers 13A through 13D, until transfer of all of the toner images to the transfer belt 11 is complete, thereby appropriately maintaining the transfer accuracy of toner images when performing color image transfer and when performing monochrome image transfer.

For example, when transferring a color image, a primary transfer bias is always applied to the primary transfer rollers 13A through 13D at least during the interval from the time at which transfer of the yellow toner image formed on the circumferential surface of the photosensitive drum 101D to the transfer belt 11 begins until the time at which transfer of the black toner image formed on the circumferential surface of the photosensitive drum 101A is complete. And, when transferring a monochrome image, a primary transfer bias is always applied to the primary transfer rollers 13A through 13D at least during the interval from the time at which transfer of the black toner image formed on the circumferential surface of the photosensitive drum 101A to the transfer belt 11 begins until the time at which transfer is complete.

The primary transfer rollers 13A through 13D are configured with a shaft of metal material (for example, stainless steel) with a diameter of 8 to 10 mm whose surface is covered in electrically conductive elastic material (such as EPDM or urethane foam, for example), and with this electrically conductive elastic material a high voltage is uniformly applied to the transfer belt 11. A brush-shaped intermediate transfer member can also be used in place of transfer rollers such as the primary transfer rollers 13A through 13D.

The primary transfer rollers 13A through 13D are respectively biased toward the respective photosensitive drums 101A through 101D in a direction that differs from the normal direction at the contact positions of the transfer belt 11 on the circumferential surface of the photosensitive drums 101A through 101D.

The toner image transferred to the outer peripheral surface of the transfer belt 11 at each primary transfer position is transported to a position facing the secondary transfer roller 14 by rotation of the transfer belt 11. During image formation, the secondary transfer roller 14 is pressed with a predetermined nip pressure against the outer peripheral surface of the transfer belt 11, the inner peripheral surface of which touches the peripheral surface of the driving roller 11A. When paper supplied from the paper supply cassette 16 or the manual paper supply tray 17 passes between the secondary transfer roller 14 and the transfer belt 11, a high voltage with a polarity opposite to that of the toner charging polarity is applied to the secondary transfer roller 14. Thus the toner image is transferred from the outer peripheral surface of the transfer belt 11 to the surface of the paper.

In order to maintain the nip pressure of the secondary transfer roller 14 and the transfer belt 11 at a predetermined value, one of either the secondary transfer roller 14 or the transfer belt 11 are configured from hard material (such as metal), and the other is configured from soft material such as an elastic roller (such as an elastic rubber roller or a foam resin roller).

Among the toner affixed to the intermediate transfer belt 11 from the photosensitive drums 101A through 101D, toner that remains on the intermediate transfer belt 11 after not being transferred onto the paper is recovered by the cleaning units 104A through 104D in order to prevent color mixture in the following process.

The paper onto which a toner image has been transferred is guided to the fixing apparatus 15, and receives heat and pressure by passing between a heat roller 15A and a pressure roller 15B. Thus, the toner image is strongly fixed to the surface of the paper. The paper to which the toner image has been fixed is discharged onto the discharge tray 18 by a discharge roller 18A.

In the image forming apparatus 100, a paper transport path F1 is provided in an approximately perpendicular direction for feeding paper stored in the paper supply cassette 16 between the secondary roller 14 and the intermediate transfer belt 11 and to the discharge tray 18 via the fixing apparatus 15. Arranged in the paper transport path F1 are a pickup roller 16A that carries paper in the paper cassette 16 into the transport path F1 page by page, a transport roller R1 that transports the paper carried out upward, a register roller 19 that guides the transported paper between the secondary transfer roller 14 and the intermediate transfer belt 11 at a predetermined timing, and a discharge roller 18A that discharges the paper to the discharge tray 18.

Also, a paper transport path F2 is formed in the interval from the manual paper supply tray 17 to the register roller 19, wherein a pickup roller 17A and transport rollers R2 through R4 are arranged. Further, a paper transport path F3 is formed in the interval from the discharge roller 18A to the upstream side of the register roller 19 in the paper transport path F1, wherein transport rollers R5 and R6 are arranged.

The discharge roller 18A is made rotatable in both the forward and reverse directions, and is driven in the direction of frontward rotation and discharges the paper to the discharge tray 18 when simplex printing is performed that forms an image on one side of the paper, or when performing image formation for the second face in duplex image formation that forms an image on both sides of the paper. On the other hand, when performing image formation for the first face in duplex image formation, after being driven in the direction of frontward rotation until the trailing edge of the paper passes the fixing apparatus 15, the discharge roller 18 is driven in the direction of reverse rotation in a state sandwiching the trailing edge of the paper, and guides the paper into the paper transport path F3. Thus, paper on which an image has been formed on only one side when performing duplex image formation is guided to the paper transport path F1 in a state in which the front and back sides and the leading and trailing edges are reversed.

The register roller 19 guides paper that has been supplied from the paper supply cassette 16 or the manual paper supply tray 17, or transported via the paper transport path F3, between the secondary transfer roller 14 and the transfer belt 11 at a timing synchronous with the rotation of the transfer belt 11. Thus, the register roller 19 stops rotating at the time that the operation of the photosensitive drums 101A through 101D and the transfer belt 11 begins, and paper supplied or transported before rotation of the transfer belt 11 stops moving in the paper transport path F1 in a state in which the leading edge is put in contact with the register roller 19. Afterwards, the register roller 19, begins rotation at the timing that the leading edge of the paper and the leading edge of the toner image formed on the transfer belt 11 face each other at the position where the secondary transfer roller 14 and the transfer belt 11 press together.

Figure 2:
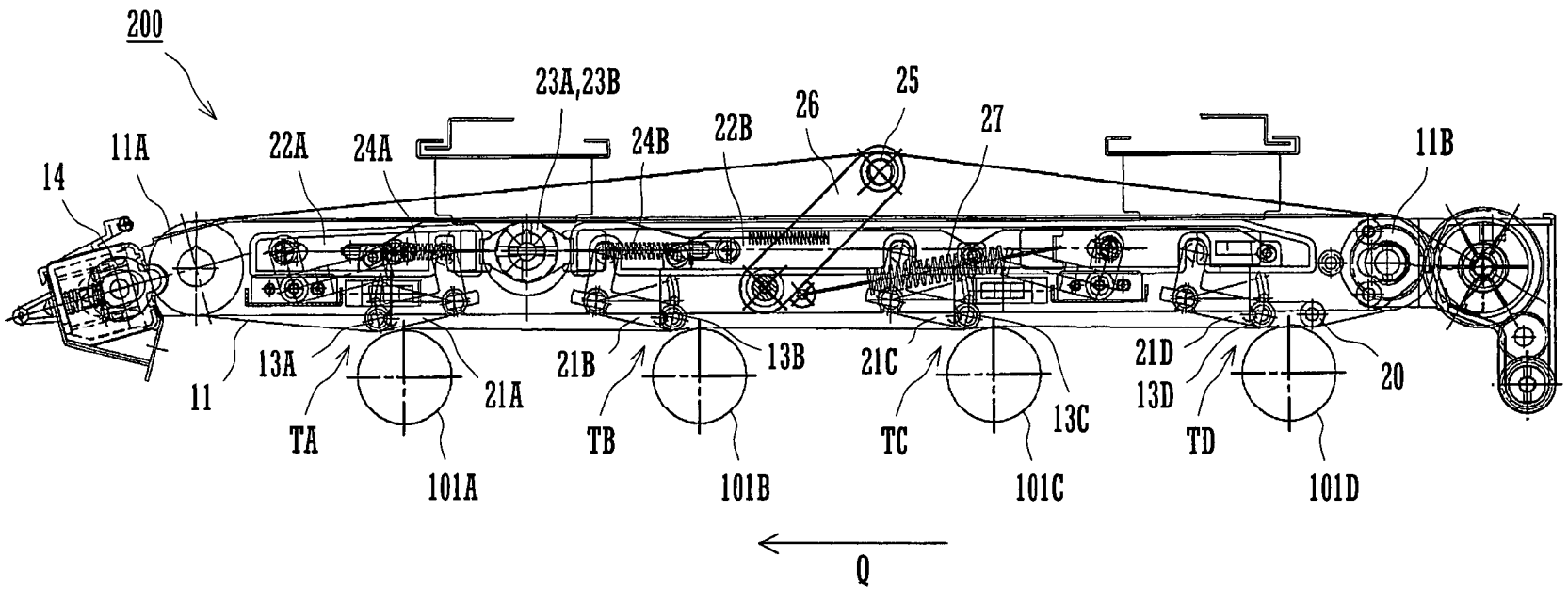
FIG. 2 is a front view that shows the configuration of the same transfer belt device.

FIG. 2 is a front view that shows the configuration of a transfer belt device according to an embodiment of this invention. In a transfer belt device 200 according to this embodiment, primary transfer positions TA through TD are disposed facing the lower side in the loop-shaped movement path of the transfer belt 11, which is tightly stretched to the driving roller 11A and the driven roller 11B. Also, the secondary transfer roller 14 is disposed at a position adjacent to the primary transfer roller 13A, on the downstream side of the primary transfer roller 13A disposed furthest downstream in the movement direction of the transfer belt 11, which is the direction of arrow Q.

This is in order to increase the speed of image formation by shortening the time until secondary transfer by the secondary transfer roller 14 is completed after primary transfer by the primary transfer roller furthest upstream has begun, while realizing a compact size for the image forming apparatus 100, in a configuration wherein secondary transfer of a toner image from the transfer belt 11 to paper transported in an approximately perpendicular direction is performed.

In the primary transfer positions TA through TD, primary transfer rollers 13A through 13D are arranged on the downstream side of the photosensitive drums 101A through 101D in the movement direction of the transfer belt 11 in positions that do not touch the photosensitive drums 101A through 101D, sandwiching the transfer belt 11. The primary transfer rollers 13A through 13D always press against the transfer belt 11 in the direction contacting the photosensitive drums 101A through 101D.

The primary transfer rollers 13A through 13D are axially supported at one end of an L shape of the roller elevating members 21A through 21D. The cross section of the roller elevating members 21A through 21D in the direction perpendicular to the axial direction of the primary transfer rollers 13A through 13D has an L shape, and is supported such that it can swing by a shaft parallel to the axial direction of the primary transfer rollers 13A through 13D in a bent portion. In the roller elevating member 21A a slide member 22A is caught at the upper end (the other end). In the roller elevating members 21B through 21D, a slide member 22B is caught at the upper end (the other end).

The slide members 22A and 22B engage a first rotating cam 23A and a second rotating cam 23B, whose circumferential faces are disposed on the same axis, and are made movable back and forth in the horizontal direction by displacement of the peripheral surface due to rotation of the rotating cams 23A and 23B and elastic force in the horizontal direction approximately parallel to the direction of arrow Q generated by springs 24A and 24B. By movement of the slide members 22A and 22B in the horizontal direction, the roller elevating members 21A through 21D swing, and the primary transfer roller 13A independently moves (rises and falls) between a position approaching the photosensitive drums 101A through 101D and a position separated therefrom, while on the other hand the primary transfer rollers 13B through 13D move between these positions as a single body.

Figure 3A:
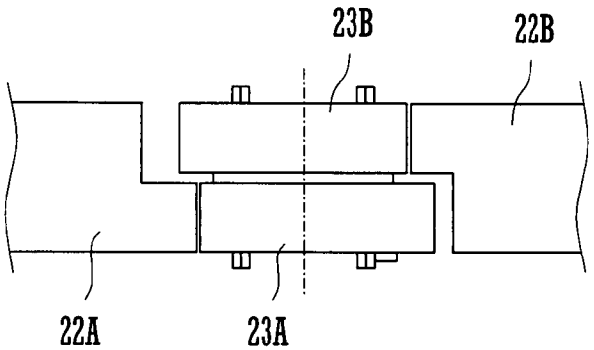
FIGS. 3A, 3B, and 3C are external views that show the configuration of a rotating cam provided in same transfer belt device.
Figure 3B:
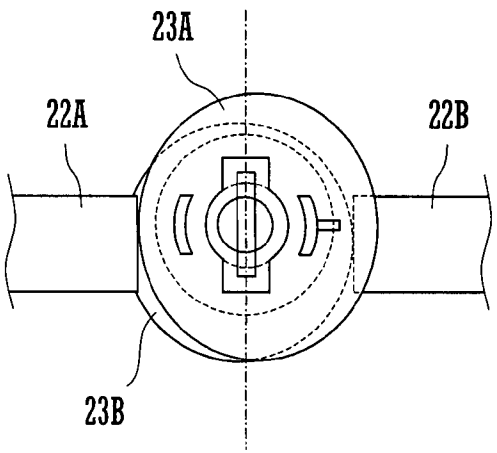
Figure 3C:
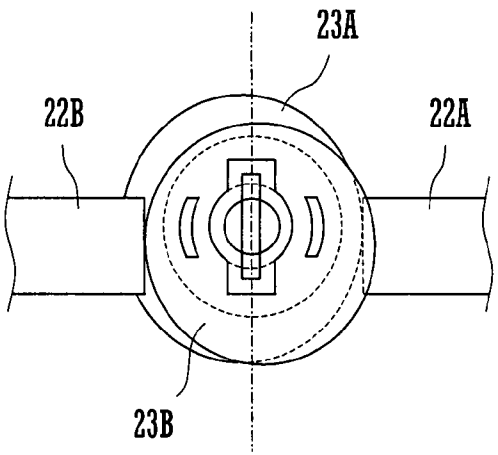

As shown in FIGS. 3A through 3C, the first rotating cam 23A and the second rotating cam 23B each have a predetermined circumferential shape, and rotate as a single body by receiving driving force from a single driving source (not shown). FIGS. 3A through 3C show the first and second rotating cams 23A and 23B when viewed from the top, front, and back sides.

By the primary transfer rollers 13A through 13D moving to positions corresponding to the positions during color image transfer (color image forming mode), monochrome image transfer (monochrome image forming mode) and standby, the shape of the transport path of the toner image of the transfer belt 11 changes. This is accompanied by vertical displacement of a tension roller 25, which is supported by the other end of a lever 26 wherein the spring 27 is caught at one end, shown in FIG. 2, and the tensile strength of the transfer belt 11 is maintained. Also, the tension roller 25 is grounded. The tension roller 25 and the spring 27 are included in the tension mechanism of this invention.

Figure 4A:
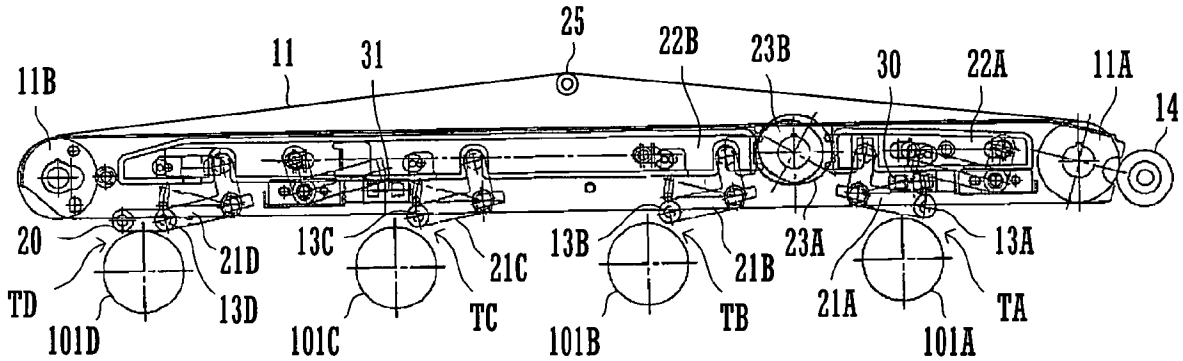
FIGS. 4A, 4B, and 4C are rear views that show the state during each mode of the same transfer belt device.
Figure 4B:
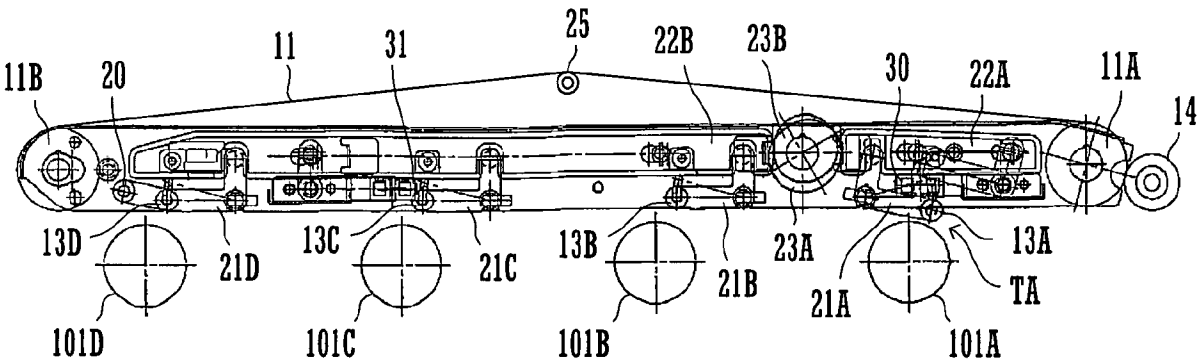
Figure 4C:
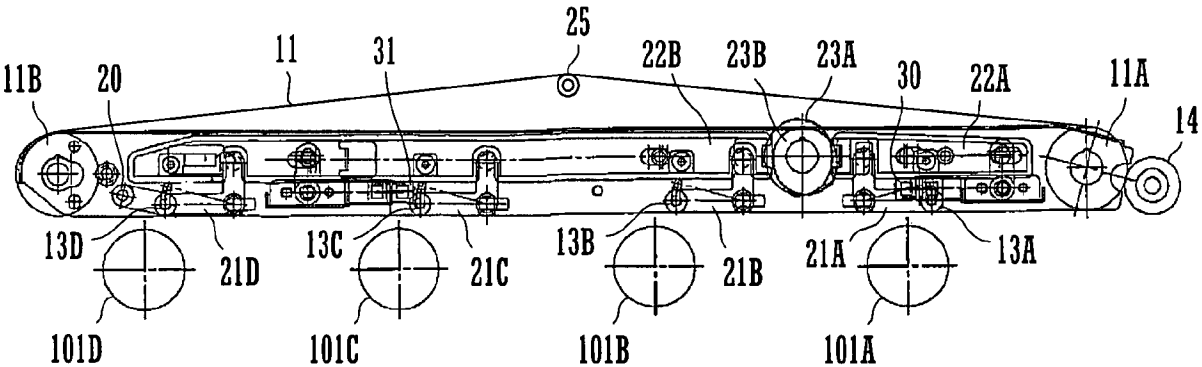

FIGS. 4A through 4C are rear views that show the state during each mode of the transfer belt device according to this embodiment of the invention. When in color image forming mode that performs color image formation, because primary transfer is performed at all of the primary transfer positions TA through TD, the monochrome image primary transfer roller 13A and the color image primary transfer rollers 13B through 13D are all lowered to a lowered position approaching the photosensitive drums 101A through 101D, as shown in FIG. 4A.

When in the monochrome image forming mode that performs monochrome image formation, because primary transfer is only performed at the primary transfer position TA, only the monochrome image primary transfer roller 13A is lowered to a lowered position approaching the photosensitive drum 101A, as shown in FIG. 4B.

During standby, which performs standby processing that does not perform image formation, as shown in FIG. 4C all of the primary transfer rollers 13A through 13D are elevated to an upper position away from the transfer belt 11.

In the transfer belt device 200 during monochrome image formation shown in FIG. 4B, the elevated primary transfer rollers 13B through 13D are shown elevated to the extent that they do not touch the transfer belt 11, but because due to their own weight they actually are lowered more than in the state shown in the illustration, the primary transfer rollers 13B through 13D make contact with the transfer belt 11. Also, because the primary transfer rollers 13A through 13D attract the transfer belt 11 due to the primary transfer bias, they are always in contact with the transfer belt 11.

The roller elevating members 21A through 21D and the slide members 22A and 22B correspond to the transfer member movement mechanism of the present invention.

Figure 5:
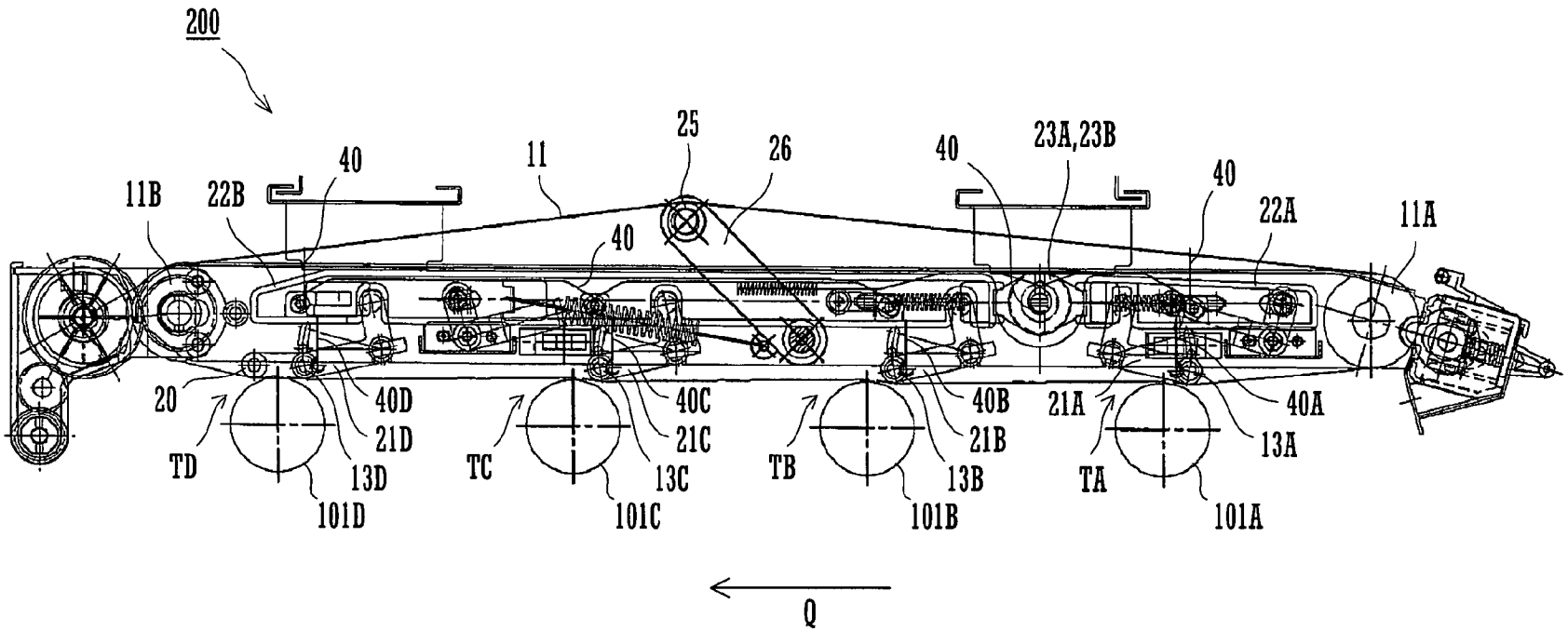
FIG. 5 is a rear view that shows the configuration of the same transfer belt device.

FIG. 5 is a rear view that shows the configuration of the transfer belt device according to this embodiment of the invention. FIG. 5 shows the state when transferring a color image. A conducting member 40 is disposed on the back side of the transfer belt device 200 that applies an equal primary transfer bias to each of the transfer rollers 13A though 13D. The conducting member 40 has the shape of a wire extended in the direction of arrow Q, is disposed in the slide members 22A and 22B, and moves along with the back and forth movement of the slide members 22A and 22B. Also, the conducting member 40 supplies electrical power to connected contact members 40A through 40D in a state in which it has revolved completely around the rotating shaft of the first rotating cam 23A and the second rotating cam 23B.

The conducting member 40 is allowed to revolve completely around the rotating shaft of the first rotating cam 23A and the second rotating cam 23B to extend and shorten the conducting member 40 by moving the conducting member 40 along with back and forth movement of the slide portions 22A and 22B. Further, electrical power is supplied to the conducting member 40 from a power source apparatus (not shown) that is connected to both ends of the conducting member 40.

In the contact members 40A through 40D, which have conductivity, one support end is fixed to the slide members 22A and 22B that are above the primary transfer rollers 13A though 13D, and the other, free end contacts the shaft of the primary transfer rollers 13A through 13D, and supplies electrical power from the conducting member 40 to the primary transfer rollers 13A through 13D. The contact members 40A through 40D always contact the primary transfer rollers 13A through 13D due to elastic force generated in the contact direction.

Figure 6A:
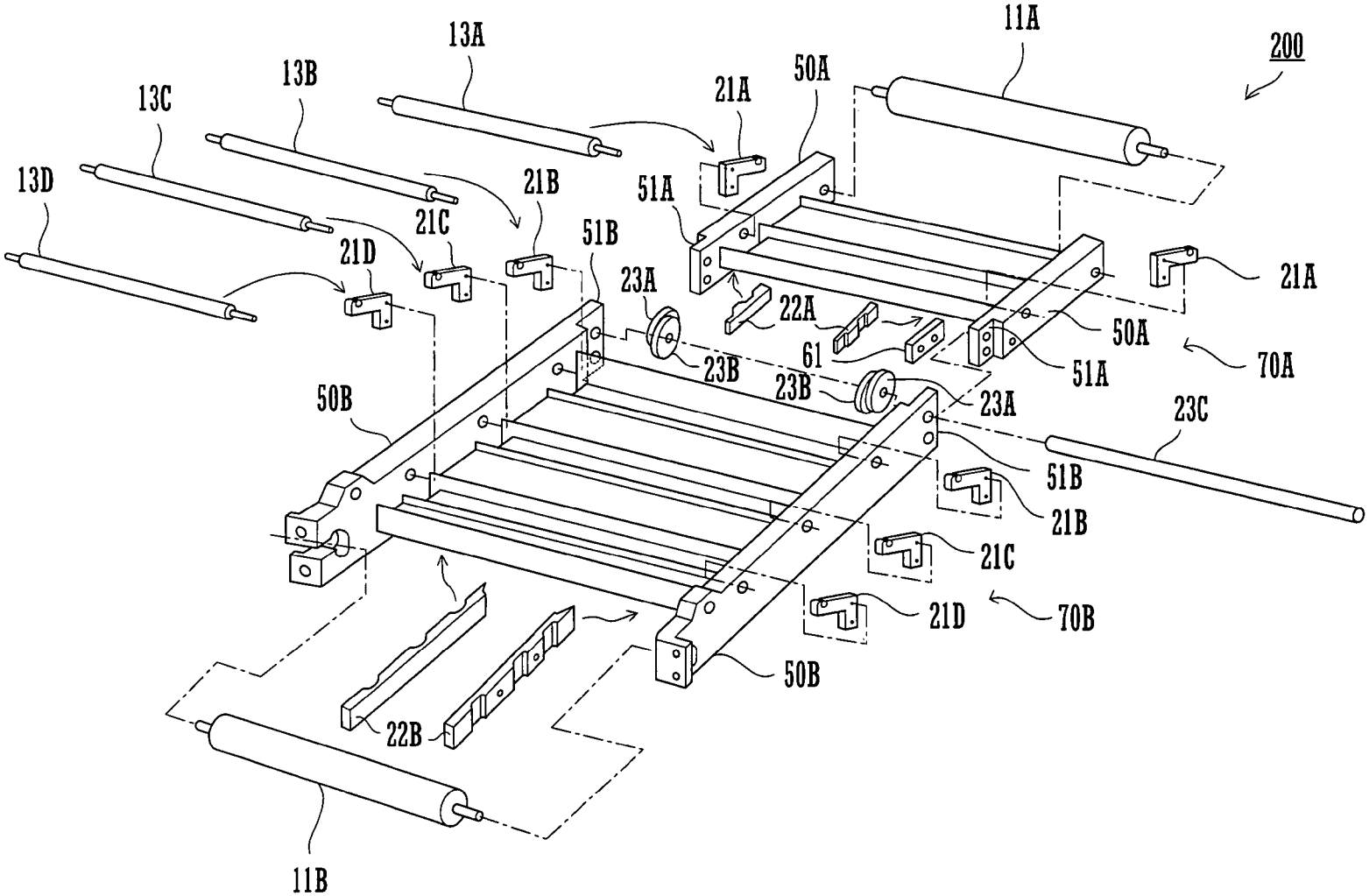
FIGS. 6A and 6B are explanatory figures that illustrate the structure of the same transfer belt device.
Figure 6B:
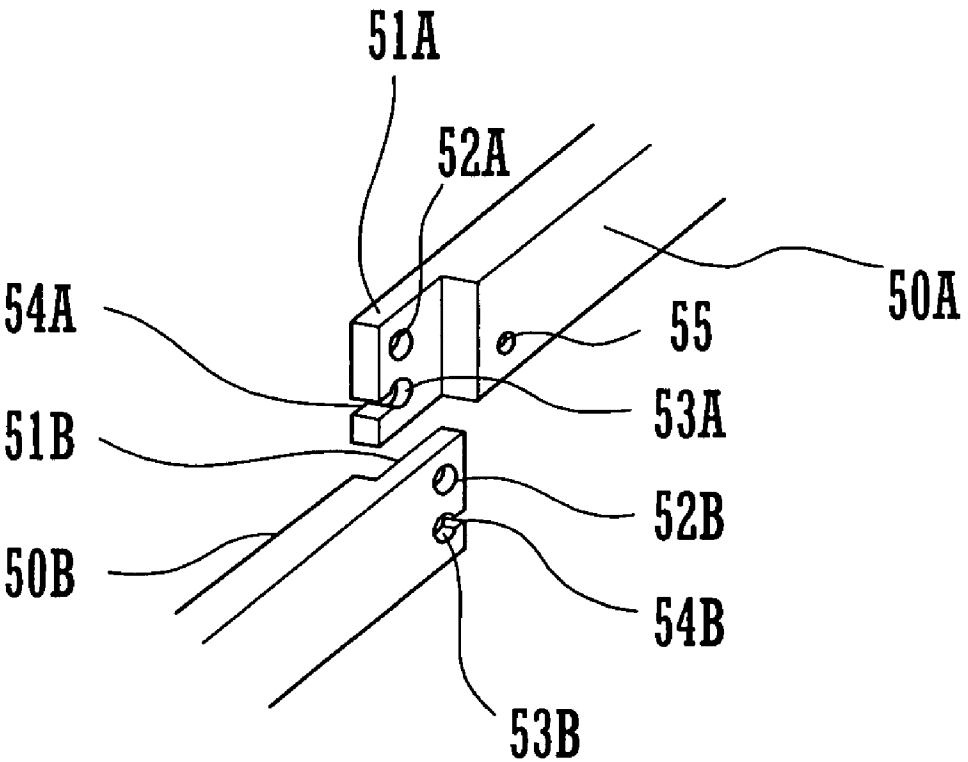

FIG. 6 is an explanatory diagram that illustrates the configuration of the transfer belt device according to this embodiment of the invention. As shown in FIG. 6, the transfer belt device 200 has a configuration wherein the transfer belt 11 is stretched to a first transfer unit 70A, with a configuration wherein a driving roller 11A, a roller elevating member 21A, a slide member 22A, and a first transfer roller 13A are disposed in a monochrome image frame 50A, and a second transfer unit 70B, with a configuration wherein a driven roller 11B, roller elevating members 21B through 21D, slide members 22B through 22D, and first transfer rollers 13B through 13D are disposed in a color frame 50B.

As shown in the enlargement of FIG. 6, in the monochrome image frame 50A and the color image frame 50B, which are a first linking member and a second linking member of the present invention, the ends 51A and 51B take the shape of a key. The ends 51A and 51B bite together to link to the monochrome image frame 50A and the color image frame 50B.

The ends 51A and 51B of the frames 50A and 50B are made of elastic deformable resin, and have fixing holes 52A and 52B, and disjoining holes 53A and 53B. While supporting the rotating shaft 23C of the first rotating cam 23A and the second rotating cam 23B such that it can rotate, the ends 51A and 51B link the monochrome frame 50A and the color frame 50B using the rotating shaft 23C as an axle. The disjoining holes 53A and 53B have guide grooves 54A and 54B.

Figure 7A:
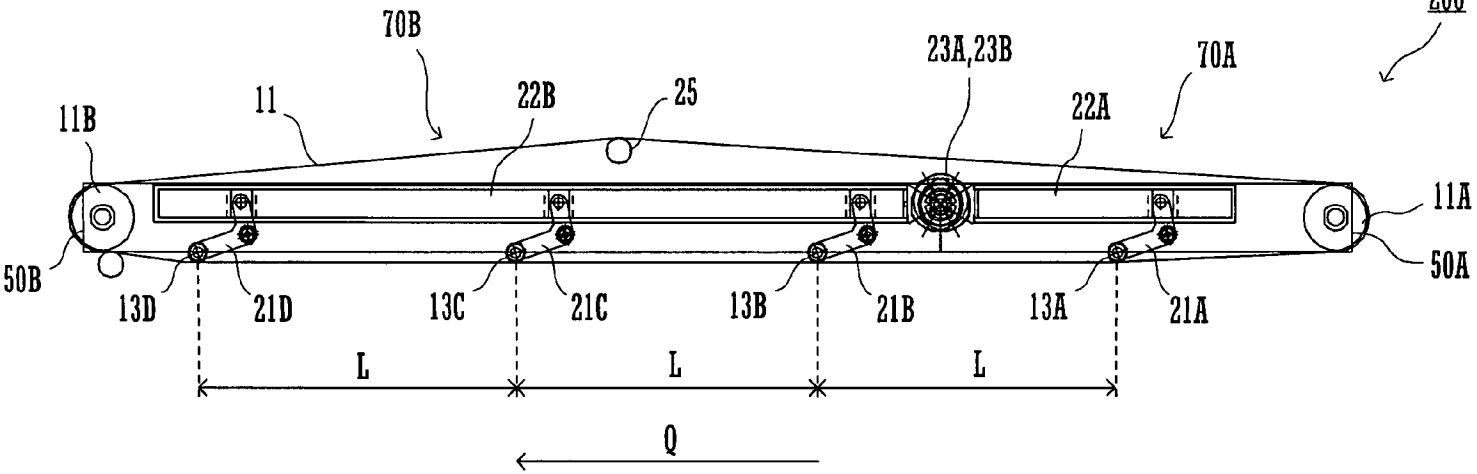
FIGS. 7A and 7B are explanatory figures that show the manner in which the same transfer belt device swings.
Figure 7B:
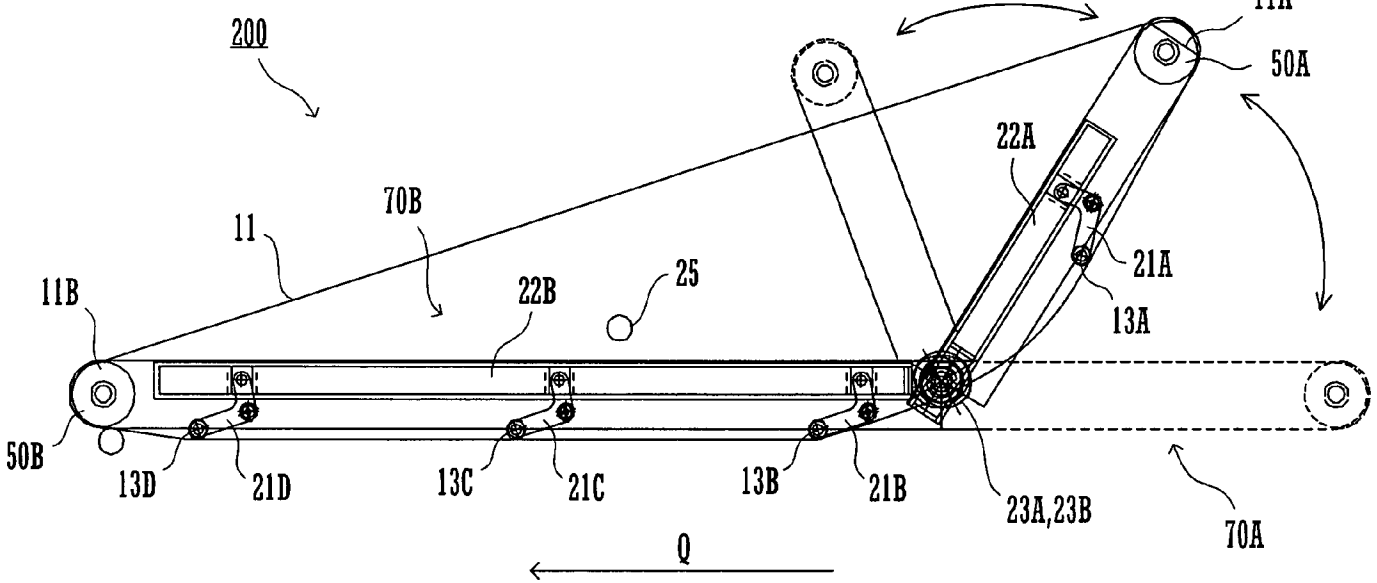

FIGS. 7A and 7B are explanatory diagrams that illustrate the manner in which the same transfer belt device swings. FIG. 7A shows a parallel state where the longitudinal direction of the first transfer unit 70A and the second transfer unit 70B is parallel to the direction of arrow Q. FIG. 7B shows a state in which the first transfer unit 70A has swung relative to the second transfer unit 70B, with the rotating shaft 23C made an axle. The first transfer unit 70A swings in the range indicated by the dotted line in FIG. 7B.

Figure 8:
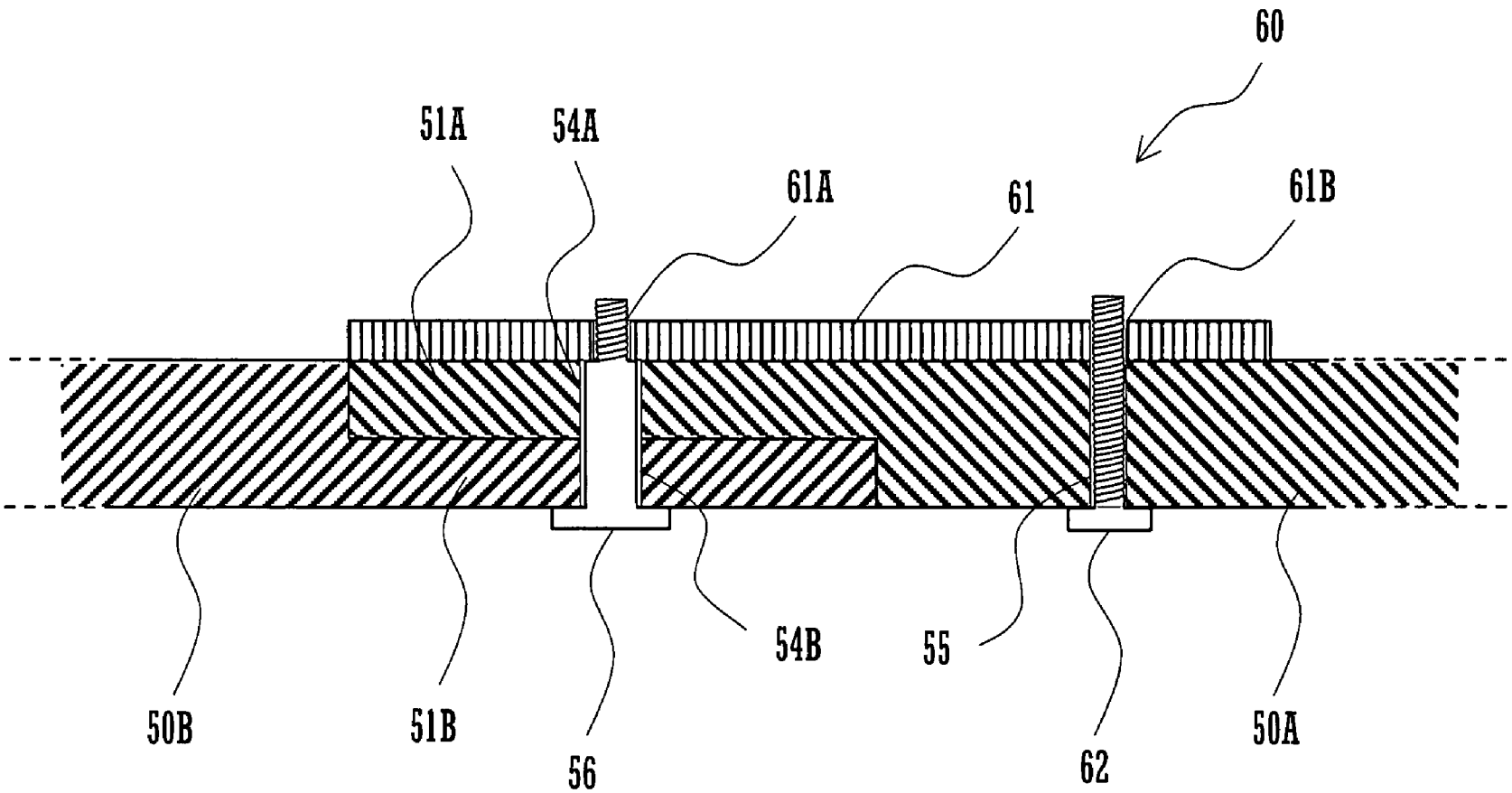
FIG. 8 is an explanatory figure that shows the manner in which the frame provided in the same transfer belt device is linked.

As shown in FIG. 8, in a parallel state, the monochrome frame 50A and the color frame 50B are fixed by linking such that the monochrome frame 50A and the color frame 50B do not swing by the joining member 60. The joining member 60 is configured from a plate 61 and a screw 62. As shown in FIG. 6, the plate 61 includes a screw hole 61A that is screwed to a step screw 56 and a screw hole 61B that is screwed to a screw 55. In the step screw 56, as shown in FIG. 8, from the outside of the monochrome frame 50A and the color frame 50B, the leading edge step that has a screw groove is screwed to the screw hole 61A of the plate 61, and the step that does not have a screw groove with a diameter larger than the step of the leading edge is fitted to the disjoining holes 53A and 53B. The screw 62 is screwed to the screw hole 55 of the monochrome frame 50A and the screw hole 61B of the plate 61 from the outside of the monochrome frame 50A.

When swinging the first transfer unit 70A, the screw 62 may be removed from the monochrome frame 50A and the plate 61. At this time, the monochrome frame 50B is fitted to the step screw 56 in the separating hole 53A, but because the groove 54A is elastically deformable, it is removed from the step screw 56 via the groove 54B when swinging. Conversely, the monochrome frame 54A that has been removed from the step screw 56 is refitted to the step screw 56 in the separating hole 53A via the groove 54A.

Accordingly, the first transfer unit 70A can swing if the screw 62 is removed from the plate 61.

Either the monochrome frame 50A side or the color frame 50B side is joined using a single plate 61, but both sides may be joined using two plates 61.

The step screw 56 fulfills the function of a stopper that regulates the swinging such that in a parallel state the lengthwise directions of the monochrome frame 50A and the color frame 50B are appropriately linked so that their longitudinal direction is parallel to the direction of the arrow Q. Also, in the conducting member 40, when the monochrome frame 50A swings, the monochrome frame 50A swings while the location completing one full orbit of the rotating shaft 23C is elastically deformed.

Thus, the straight-line distance between the positions where the rollers 11A and 11B provided in the first transfer unit 70A and the second transfer unit 70B touch the transfer belt 11 shortens enough to loosen the tension on the tightly stretched transfer belt 11, and so the transfer belt 11 can be easily removed from the first transfer unit 70A and the second transfer unit 70B, and the transfer belt 11, the first transfer unit 70A and the second transfer unit 70B can be easily replaced.

Also, because a parallel state is maintained using the joining member 60, in the parallel state a developer image can be transferred to the transfer belt 11 without the first transfer unit 50A swinging, and it is possible to preserve transfer accuracy while maintaining removability of the transfer belt.

Further, because the first transfer unit 70A is swung toward the position where the tension roller 25 causes tensile force to act on the transfer belt 11, the transfer belt 11 separates from the tension roller 25 by swinging, and the tension roller 25 stops causing tensile force to act on the transfer belt 11. Thus, it is possible to more easily loosen the tightly stretched transfer belt, and the transfer belt, the first transfer unit, and the second transfer unit can be more easily replaced.

The swing range of the first transfer unit 70A may be a range wherein the tension on the transfer belt 11 loosens enough that it is possible to easily remove the first transfer unit 70A and the second transfer unit 70B from the transfer belt 11.

In a parallel state as shown in FIG. 6A wherein color image formation is performed with all of the primary transfer rollers 13A through 13D lowered, the interval with which all of the primary transfer rollers 13A through 13D are disposed is approximately equal to an integral multiple of the length of the outer circumferential face of the driving roller 11*a*. In the present embodiment, all of the intervals at which the primary transfer rollers are disposed are approximately equal to the length L of the outer circumferential face of the driving roller 11A. Approximately equal means that a tolerance has also been taken into consideration.

Thus, regulation when transferring and layering together (registering) the toner images formed on the surface of the photosensitive drums 101A through 101D can be easily performed.

This is because, in the present embodiment, the transfer timing at the respective primary transfer locations TA through TD for transferring the toner images formed on the photosensitive drums 101A through 101D is based on the number of revolutions of the driving roller 11A, and so the transfer timing can be accurately set based on the number of revolutions of the driving roller, and the transfer timing is not influenced by the rotational speed of the driving roller 11A.

In the present embodiment, all of the intervals at which the primary transfer rollers 13A through 13D are disposed are made approximately equal to an integral multiplier of the length of the outer circumferential face of the driving roller 11A, but a configuration may also be adopted wherein they are not all disposed with the same interval, and the respective intervals at which they are disposed may vary if they are approximately equal to an integral multiplier of the length of the outer circumferential face of the driving roller 11A. For example, as shown in FIG. 7, a configuration may be adopted wherein the interval between the primary transfer rollers 13A and 13B is made twice (2L) the length of the outer circumferential face of the driving roller 11A, and the interval between the primary transfer rollers 13B through 13D is made L.

Thus, as shown in FIG. 8, it is possible to use the photosensitive drum 101A with a larger diameter than the color photosensitive drums 101B through 101D as the photosensitive drum for monochrome images, and use only the photosensitive drum 101A as a long-life photosensitive drum.

This is because remaining toner affixed on the surface of the photosensitive drums 101A through 101D after transfer of the toner images is eliminated (removed) by the cleaning units 104A through 104D, but when doing so the photosensitive layer of the surface is also eliminated along with the remaining toner. Thus, the more that the photosensitive drums 101A through 101D are used, the more their photosensitive layers are removed, shortening their lifetime. However, the longer the length of the outer circumferential face, the more the frequency of use of the same portion is reduced, and the life of the photosensitive drums is increased.

Because the monochrome photosensitive drum 101A is used for both color image formation and monochrome image formation, it has a higher frequency of use than the color image photosensitive drums 101B through 101D. Thus, even if the lives of the monochrome photosensitive drum 101A and the color photosensitive drums 101B through 101D are the same, because the usable time period of the monochrome photosensitive drum 101A is shorter, lengthening the life of the monochrome photosensitive drum 101A is effective for being able to make the period for maintenance work such as the time for replacement the same as the period for the color photosensitive drums 101B through 101D.

Also, by making the diameter of the photosensitive drum 101A larger, it is possible to achieve increased speed for monochrome image formation. This is because when the length of the outer circumferential face is short, the area touched by the charging roller 103A and the cleaning roller 104A disposed on the outer circumferential face of the photosensitive drum 101A becomes smaller, and work capabilities such as charging and removal of remaining toner are reduced, and so working time must be insured by reducing the rotational speed of the photosensitive drum 101A.

However, with respect to the transfer belt device 200 of the present embodiment and the transfer belt device 200 shown in FIG. 7 described above, it is possible to adopt a configuration wherein only the configuration of the first transfer unit 70A is different, and the configuration of the other portions is exactly the same. Accordingly, it is possible to achieve a sharing of the components of the transfer belt device 200 among a plurality of models of the image forming apparatus 100. For example, as stated above it is possible to share only the second transfer unit 70B among all models, and change only the first transfer unit 70A for each model according to the purpose of the apparatus (for example, image forming speed).

Thus, it is possible to reduce an increase in the number of types of components that accompanies an increase in the number of models of the transfer belt device 200. Additionally, because the first linking unit and the second linking unit are linked by the monochrome frame 50A and the color frame 50B, it is also possible to share the assembly method among a plurality of models of the transfer belt device 200.

Thus, it is possible to increase the number of models of the transfer belt device 200 and image forming apparatus 100 while suppressing an increase in cost.

Also, because the first transfer unit 70A and the second transfer unit 70B are linked such that they can swing around the first rotating cam 23A, the second rotating cam 23B, and the rotating shaft 23C, it is not necessary to newly provide a shaft for the purpose of linking and swinging the first transfer unit 70A and the second transfer unit 70B, the configuration of the transfer belt device 200 can be simplified, and it is possible to easily swing the first transfer unit 70A relative to the second transfer unit 70B.

Also, the first transfer belt can be easily removed from the first transfer unit 70A and the second transfer unit 70B, and the workability of performing replacement of the transfer belt 11, the first transfer unit 70A, and the second transfer unit 70B can be improved.

Further, in the present embodiment, as shown in FIG. 6, because the first rotating cam 23A, the second rotating cam 23B, and the rotating shaft 23C are provided in the second transfer unit 70B, when linking the first transfer unit 70A and the second transfer unit 70B it is, for example, not necessary to perform the troublesome work of linking the first transfer unit 70A and the second transfer unit 70B after incorporating the driving mechanism into the first transfer unit, the workability of linking the first transfer unit 70A and the second transfer unit 70B can be improved, and the transfer belt device 200 can be easily assembled.

Also, the first rotating cam 23A, the second rotating cam 23B, and the rotating shaft 23C, which are the driving mechanism in the first transfer unit 70A, may be provided in the first transfer unit 70A.

Figure 9:
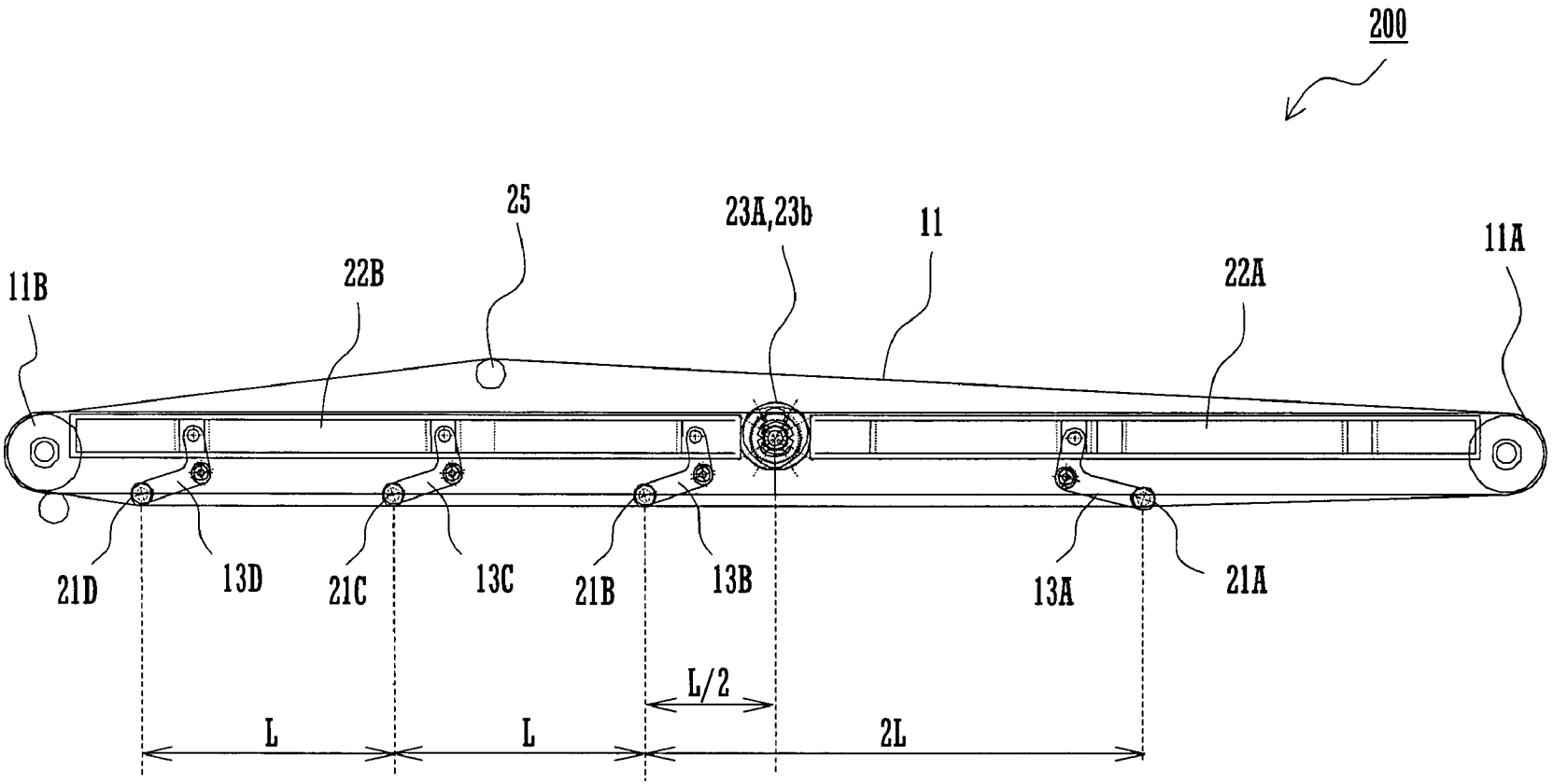
FIG. 9 is a front view that shows the configuration of the same transfer belt device.
Figure 10:
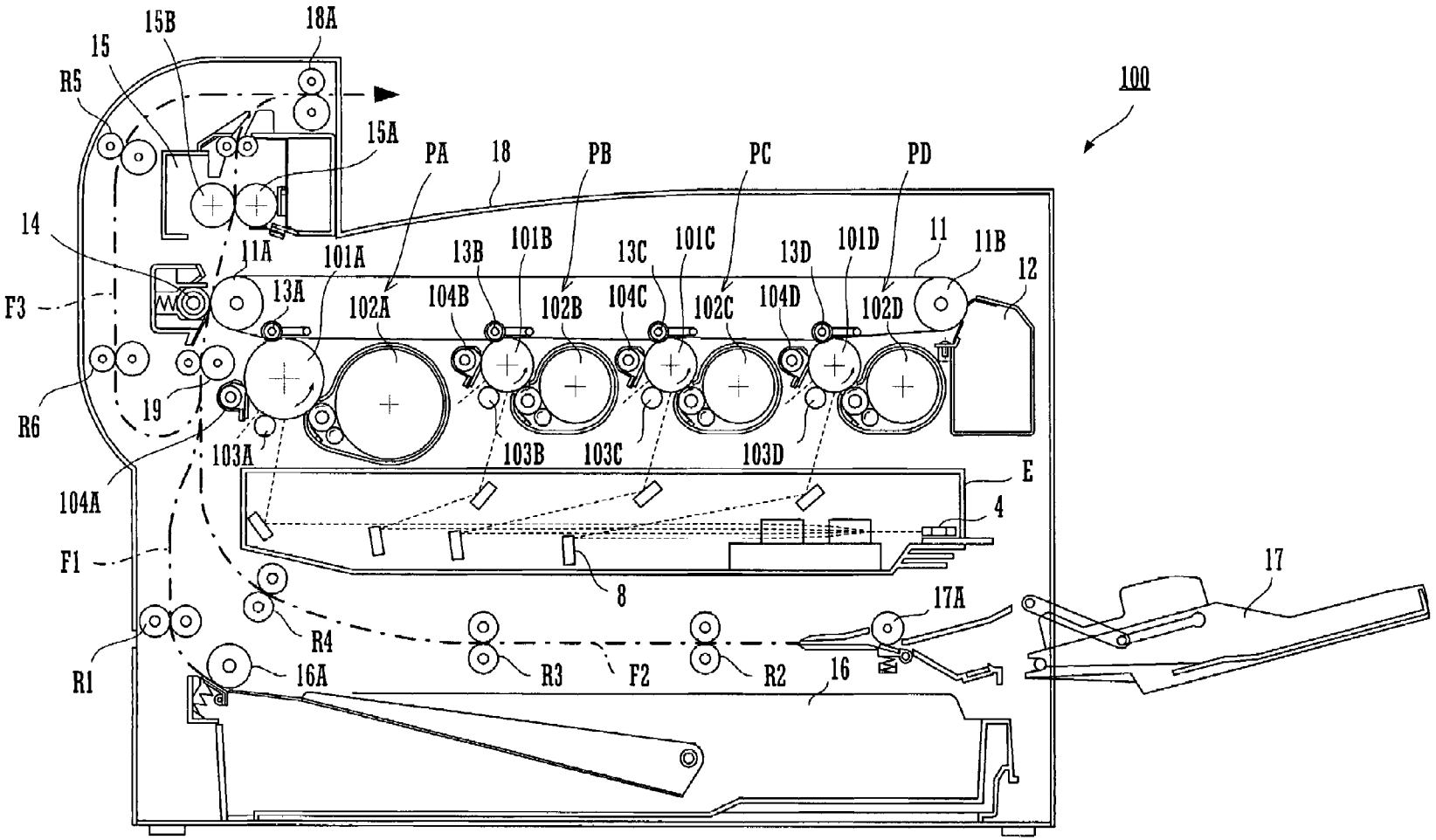
FIG. 10 is a diagram that shows the configuration of an image forming apparatus provided with the same transfer belt device.
Figure 11:
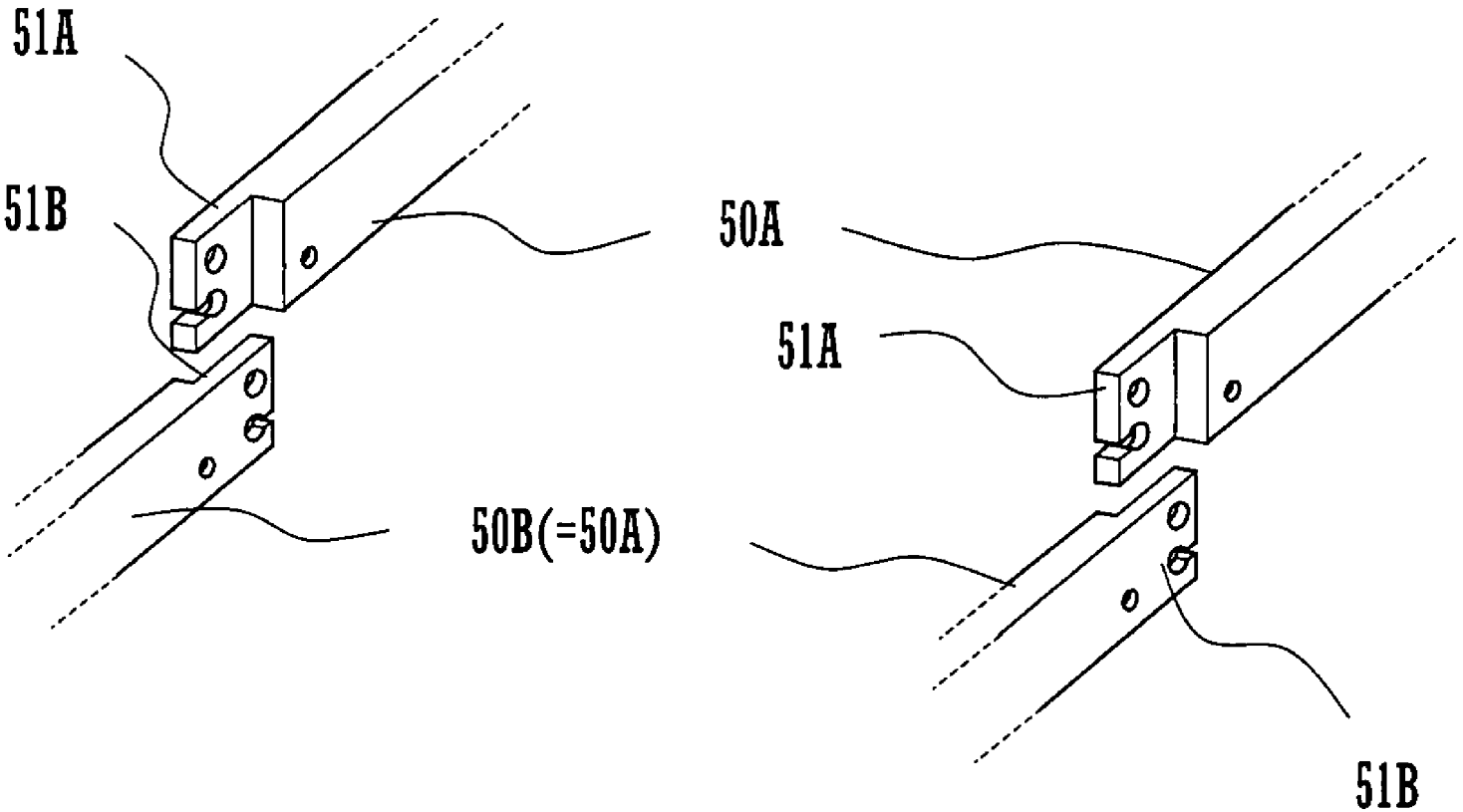
FIG. 11 is an enlarged view wherein the configuration of a part of the frame provided in the same transfer belt device is enlarged.

Also, as shown in FIG. 11, a configuration may be adopted wherein the monochrome image frame 50A and the color image frame 50B have the same shape. For example, as shown in FIG. 11 the directions of the key portion of the ends 51A and 51B of the monochrome image frame 50A and the color image frame 50B are all formed in the same direction. Thus, it is possible to link the monochrome image frame 50A and the color image frame 50B in a state wherein they are matched in the vertical direction, and the same sort of transfer belt device 200 as the transfer belt device 200 shown in FIG. 9 can be formed. Also, the roller elevating members 21A through 21D and the slide members 22A and 22B and the like that constitute the first transfer units 70A and 70B are respectively configured for use for monochrome images and color images.

Thus, it is possible to further achieve a sharing of components, and because it is possible to reduce the increase in the number of types of components that accompanies an increase in the number of models of the transfer belt device 200, it is possible to increase the number of models of the transfer belt device 200 and the image forming apparatus 100 while suppressing an increase in cost.

Also, in the embodiment of the invention, a configuration is used wherein a toner image is transferred to the transfer belt 11 and then transported, but the invention is not restricted to such a configuration. A configuration may also be adopted wherein a toner image is transferred to a recording medium while transporting the recording medium with the transfer belt 11.

Finally, the embodiments described above are to be considered in all respects as illustrative and not limiting. The scope of the invention is indicated by the appended claims rather than by the foregoing embodiments. Furthermore, all changes which come within the meaning and range of equivalency of the claims are intended to be embraced in the scope of the invention.

What is claimed is:

1. A transfer belt device comprising:

an endless transfer belt, tightly stretched by a plurality of rollers and forming a transport path in which a recording medium or a developer image is transported facing a monochrome image bearing member and a plurality of color image bearing members arranged in parallel along a fixed direction;

a first transfer unit that comprises at least one of the plurality of rollers, a monochrome image transfer roller that can be raised and lowered and that transfers a developer image formed on the monochrome image bearing member onto the recording medium or an outer peripheral surface of the transfer belt, a monochrome image transfer member movement mechanism provided with the monochrome image transfer roller, and a first linking member provided with the monochrome image transfer member movement mechanism;

a second transfer unit that comprises at least one of the plurality of rollers other than the roller included in the first transfer unit, a plurality of color image transfer rollers that can be raised and lowered and that transfer developer images formed on each of the plurality of color image bearing members onto the recording medium or the outer peripheral surface of the transfer belt, a color image transfer member movement mechanism provided with the plurality of color image transfer rollers, and a second linking member provided with the color image transfer member movement mechanism; and a driving mechanism that raises and lowers the transfer rollers via the monochrome image transfer member movement mechanism and the color image transfer member movement mechanism, and comprises a single rotating shaft that receives a transmission of driving force and supplies the driving force to the monochrome image transfer member movement mechanism and the color image transfer member movement mechanism;

wherein the first linking member and the second linking member are linked at the rotating shaft such that they can swing.

2. The transfer belt device according to claim 1, wherein the driving mechanism has a predetermined circumferential shape, and comprises a first rotating cam and a second rotating cam supported by the rotating shaft that respectively drives tho monochrome image transfer member movement mechanism and the color image transfer member movement mechanism due to rotation along with displacement of the peripheral surface, and wherein the first linking member and the second linking member are linked such that they can swing around the rotating shaft.

3. The transfer belt device according to claim 1, wherein the driving mechanism is provided in the first transfer unit or the second transfer unit.

4. The transfer belt device according to claim 1, wherein the driving mechanism is provided in the second transfer unit.

5. The transfer belt device according to claim 1, further comprising a tension mechanism that allows tensile force to act on the transfer belt at a position facing the position where the monochrome image bearing member and the plurality of color image bearing members are disposed via the first transfer unit and the second transfer unit, and wherein the first transfer unit or the second transfer unit, in a parallel state in which the longitudinal direction of the first transfer unit and the second transfer unit is parallel to the fixed direction, swings relative to the second transfer unit or the first transfer unit in a direction approaching the position where the tension mechanism allows tensile force to act on the transfer belt.

6. The transfer belt device according to claim 1, further comprising a joining member that joins the first linking member and the second linking member in a parallel state.

7. An image forming apparatus comprising:

a monochrome image bearing member on which a monochrome developer image is formed;

a plurality of color image bearing members on which a color developer image is formed;

a transfer belt device comprising:

an endless transfer belt, tightly stretched by a plurality of rollers and forming a transport path in which a recording medium or a developer image is transported facing a monochrome image bearing member and a plurality of color image bearing members arranged in parallel along a fixed direction;

a first transfer unit that comprises at least one of the plurality of rollers, a monochrome image transfer roller that can be raised and lowered and that transfers a developer image formed on the monochrome image bearing member onto the recording medium or an outer peripheral surface of the transfer belt, a monochrome image transfer member movement mechanism provided with the monochrome image transfer roller, and a first linking member provided with the monochrome image transfer member movement mechanism, a second transfer unit that comprises at least one of the plurality of rollers other than the roller included in the first transfer unit, a plurality of color image transfer rollers that can be raised and lowered and that transfer developer images formed on each of the plurality of color image bearing members onto the recording medium or the outer peripheral surface of the transfer belt, a color image transfer member movement mechanism provided with the plurality of color image transfer rollers, and a second linking member provided with the color image transfer member movement mechanism, and a driving mechanism that raises and lowers the transfer rollers via the monochrome image transfer member movement mechanism and the color image transfer member movement mechanism, and comprises a single rotating shaft that receives a transmission or driving force and supplies the driving force to the monochrome image transfer member movement mechanism and the color image transfer member movement mechanism, wherein the first linking member and the second linking member are linked at the rotating shaft such that they can swing; and wherein after the monochrome developer image formed on the monochrome image bearing member and the plurality of color developer images respectively formed on the plurality of color image bearing members are transferred to the transfer belt, they are transferred to the recording medium.

8. The image forming apparatus according to claim 7, wherein the driving mechanism has a predetermined peripheral shape, and comprises a first rotating cam and a second rotating cam supported by the rotating shaft that respectively drives the monochrome image transfer member movement mechanism and the color image transfer member movement mechanism due to rotation along with displacement of the peripheral surface, and wherein the first linking member and the second linking member are linked such that they can swing around the rotating shaft.

9. The image forming apparatus according to claim 7, wherein the driving mechanism is provided in the first transfer unit or the second transfer unit.

10. The image forming apparatus according to claim 7, wherein the driving mechanism is provided in the second transfer unit.

11. The image forming apparatus according to claim 7, further comprising a tension mechanism that allows tensile force to act on the transfer belt at a position facing the position where the monochrome image bearing member and the plurality of color image bearing members are disposed via the first transfer unit and the second transfer unit, wherein the first transfer unit or the second transfer unit, in a parallel state in which the longitudinal direction of the first transfer unit and the second transfer unit is parallel to the fixed direction, swings relative to the second transfer unit or the first transfer unit in a direction approaching the position where the tension mechanism allows tensile force to act on the transfer belt.

12. The image forming apparatus according to claim 7, further comprising a joining member that joins the first linking member and the second linking member in a parallel state.

13. An image forming apparatus comprising:

a monochrome image bearing member on which a monochrome developer image is formed;

a plurality of color image bearing members on which a color developer image is formed;

a transfer belt device comprising:

an endless transfer belt, tightly stretched by a plurality of rollers and forming a transport path in which a recording medium or a developer image is transported facing a monochrome image bearing member and a plurality of color image bearing members arranged in parallel along a fixed direction;

a first transfer unit that comprises at least one of the plurality of rollers, a monochrome image transfer roller that can be raised and lowered and that transfers a developer image formed on the monochrome image bearing member onto the recording medium or an outer peripheral surface of the transfer belt, a monochrome image transfer member movement mechanism provided with the monochrome image transfer roller, and a first linking member provided with the monochrome image transfer member movement mechanism, a second transfer unit that comprises at least one of the plurality of rollers other than the roller included in the first transfer unit, a plurality of color image transfer rollers that can be raised and lowered and that transfer developer images formed on each of the plurality of color image bearing members onto the recording medium or an outer peripheral surface of the transfer belt, a color image transfer member movement mechanism provided with the plurality of color image transfer rollers, and a second linking member provided with the color image transfer member movement mechanism, and a driving mechanism that raises and lowers the transfer rollers via the monochrome image transfer member movement mechanism and the color image transfer member movement mechanism, and comprises a single rotating shaft that receives a transmission of driving force and supplies the driving force to the monochrome image transfer member movement mechanism and the color image transfer member movement mechanism, wherein the first linking member and the second linking member are linked at the rotating shaft such that they can swing; and wherein the monochrome developer image formed on the monochrome image bearing member and the plurality of color developer images respectively formed on the plurality of color image bearing members are transferred to the recording medium transported on the transfer belt.

14. The image forming apparatus according to claim 13, wherein the driving mechanism has a predetermined peripheral shape, and comprises a first rotating cam and a second rotating cam supported by the rotating shaft that respectively drives the monochrome image transfer member movement mechanism and the color image transfer member movement mechanism due to rotation along with displacement of the peripheral surface, and wherein the first linking member and the second linking member are linked such that they can swing around the rotating shaft.

15. The image forming apparatus according to claim 13, wherein the driving mechanism is provided in the first transfer unit or the second transfer unit.

16. The image forming apparatus according to claim 13, wherein the driving mechanism is provided in the second transfer unit.

17. The image forming apparatus according to claim 13, further comprising a tension mechanism that allows tensile force to act on the transfer belt at a position facing the arranged position of the monochrome image bearing member and the plurality of color image bearing members via the first transfer unit and the second transfer unit, wherein the first transfer unit or the second transfer unit, in a parallel state in which the longitudinal direction of the first transfer unit and the second transfer unit is parallel to the fixed direction, swings relative to the second transfer unit or the first transfer unit in a direction approaching the position where the tension mechanism allows tensile force to act on the transfer belt.

18. The image forming apparatus according to claim 13, further comprising a joining member that joins the first linking member and the second linking member in a parallel state.

* * * * *